US010772481B2

(12) United States Patent
Agrawal et al.

(10) Patent No.: US 10,772,481 B2
(45) Date of Patent: Sep. 15, 2020

(54) CARRIER ROLLER ASSEMBLY FOR A RACK OF A DISHWASHER APPLIANCE

(71) Applicant: Haier US Appliance Solutions, Inc., Wilmington, DE (US)

(72) Inventors: Abhisek Agrawal, Louisville, KY (US); Jeffrey Thomas Kiesler, Louisville, KY (US); Sukumar Arrojula, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 262 days.

(21) Appl. No.: 15/900,857

(22) Filed: Feb. 21, 2018

(65) Prior Publication Data

US 2019/0254499 A1 Aug. 22, 2019

(51) Int. Cl.
*A47L 15/50* (2006.01)

(52) U.S. Cl.
CPC ..... *A47L 15/507* (2013.01)

(58) Field of Classification Search
CPC ..... A47L 15/50; A47L 15/507
USPC ..... 134/165
See application file for complete search history.

(56) References Cited

U.S. PATENT DOCUMENTS 9,462,930 B2 10/2016 Bastuji et al.
2015/0164301 A1* 6/2015 Bartloff ..... A47B 95/043 211/41.8

FOREIGN PATENT DOCUMENTS

EP 2106235 B1 6/2013

* cited by examiner

*Primary Examiner* — Tinsae B Ayalew
(74) *Attorney, Agent, or Firm* — Dority & Manning, P.A.

(57) ABSTRACT

A dishwasher appliance includes a carrier roller assembly for supporting a rack within a wash chamber. The carrier roller assembly includes a carrier body defining a receiving slot for receiving a wire of the rack. A first and a second retention clip extend from the carrier body into the receiving slot for securely locking the wire in position after it is fully inserted into the receiving slot. The first retention clip and the second clip are different sizes for snapping around and securing wires having different diameters such that the carrier roller assembly is versatile and may be universally used with dishwasher appliances using differing wire sizes.

20 Claims, 5 Drawing Sheets

CARRIER ROLLER ASSEMBLY FOR A RACK OF A DISHWASHER APPLIANCE

FIELD OF THE INVENTION

The present disclosure relates generally to dishwasher appliances, and more particularly to carrier roller assemblies for supporting the racks of dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Conventional dishwasher appliances include slide assemblies for supporting one or upper racks within the wash chamber. These slide assemblies permit a user to slide the upper racks out of the wash chamber for emptying and loading dishes and back into the wash chamber for running a wash cycle. Similarly, typical racks are slidable into and out of the wash chamber between cycles for removing and loading dishes, but rely on roller assemblies to achieve such movement. Particularly, carrier roller assemblies are typically mounted to the rack and include a plurality of rollers that roll along the dishwasher door which opens to a horizontal position. Notably, however, conventional carrier roller assemblies are formed from many parts, require different mold parts for the left and right sides of the rack, and are unable to accommodate racks formed from wires having different sizes. As a result, manufacturing complexity is increased, part procurement and storage is complicated, and appliance assembly is complex and costly.

Accordingly, a dishwasher appliance that utilizes an improved carrier roller assembly would be useful. More specifically, a carrier roller assembly that is simple to assemble, versatile, and may be universally used with different wash racks having different wire diameters and on the left and right side of the racks in different model dishwashers would be particularly beneficial.

BRIEF DESCRIPTION OF THE INVENTION

The present subject matter provides a dishwasher appliance including a carrier roller assembly for supporting a rack within a wash chamber. The carrier roller assembly includes a carrier body defining a receiving slot for receiving a wire of the rack. A first and a second retention clip extend from the carrier body into the receiving slot for securely locking the wire in position after it is fully inserted into the receiving slot. The first retention clip and the second clip are different sizes for snapping around and securing wires having different diameters such that the carrier roller assembly is versatile and may be universally used with dishwasher appliances using differing wire sizes. Additional aspects and advantages of the invention will be set forth in part in the following description, may be apparent from the description, or may be learned through practice of the invention.

In accordance with one exemplary embodiment of the present disclosure, a dishwasher appliance defining a vertical, a lateral, and a transverse direction is provided. The dishwasher appliance includes a wash tub that defines a wash chamber for receipt of articles for washing and a rack slidably positioned within the wash chamber and configured for movement along the transverse direction. A door is rotatably mounted to the wash tub for providing selective access to the wash chamber, the door defining a rack rolling surface. A carrier roller assembly supports the rack and includes a carrier body mounted to the rack, the carrier body defining a receiving slot for receiving a wire of the rack, the receiving slot being defined in part by a first wall. A first retention clip extends from the carrier body into the receiving slot, a distal end of the first retention clip being spaced apart from the first wall by a first gap height. A second retention clip extends from the carrier body into the receiving slot, a distal end of the second retention clip being spaced apart from the first wall by a second gap height, the second gap height being smaller than the first gap height.

In accordance with another exemplary embodiment of the present disclosure, a carrier roller assembly for supporting a rack within a wash chamber of a dishwasher appliance is provided. The carrier roller assembly includes a carrier body mounted to the rack, the carrier body defining a receiving slot for receiving a wire of the rack, the receiving slot being defined in part by a first wall. A first retention clip extends from the carrier body into the receiving slot, a distal end of the first retention clip being spaced apart from the first wall by a first gap height. A second retention clip extends from the carrier body into the receiving slot, a distal end of the second retention clip being spaced apart from the first wall by a second gap height, the second gap height being smaller than the first gap height.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
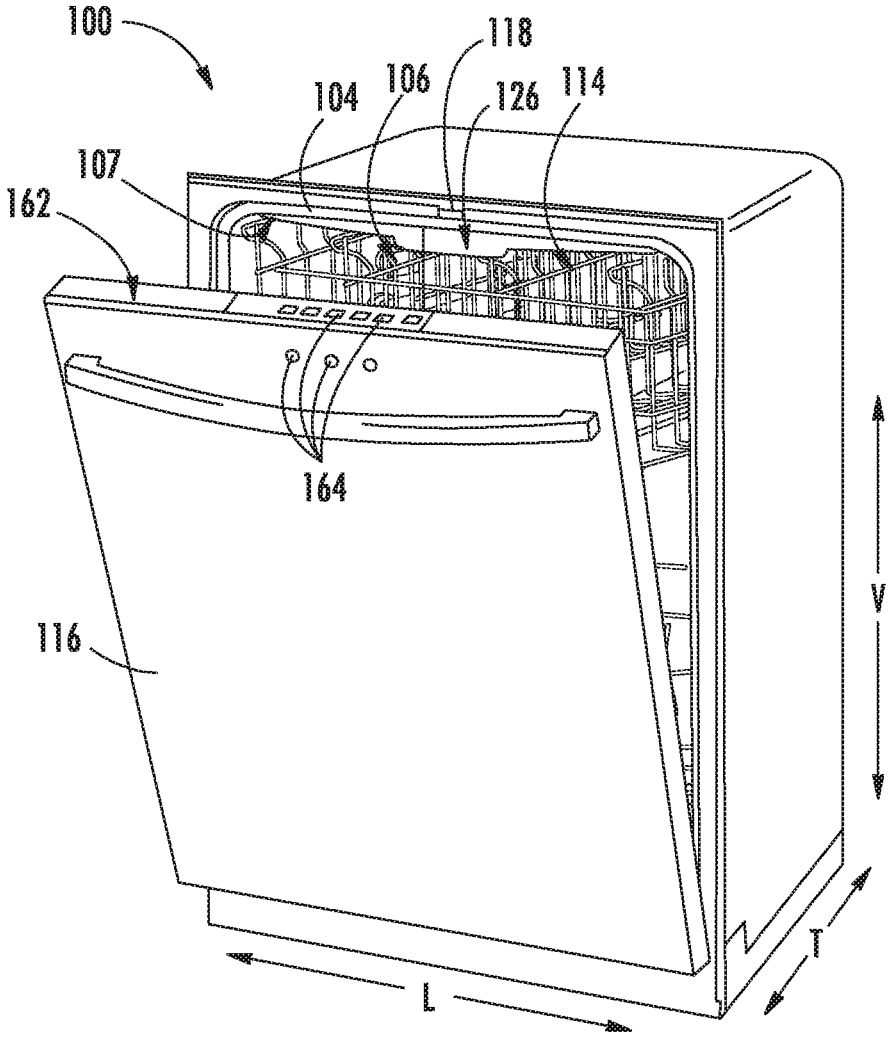
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
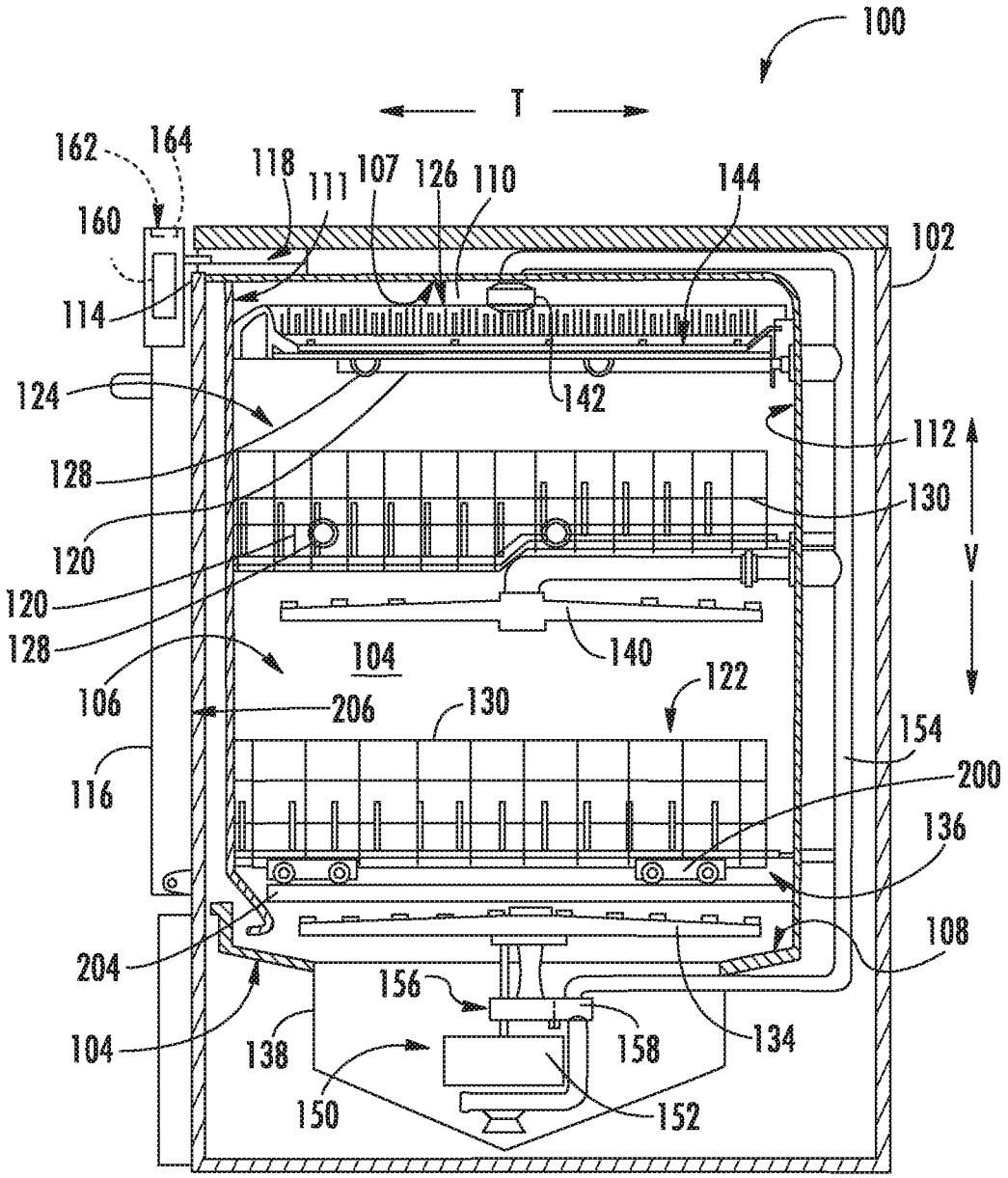
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, a lower rack assembly 122, a middle rack assembly 124, and an upper rack assembly 126 are stacked along the vertical direction V within wash chamber 106. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. With respect to middle rack assembly 124 and upper rack assembly 126, this is facilitated, for example, by guide rails 120 which are mounted to side walls 110 and rollers 128 mounted onto rack assemblies 124, 126, respectively. In addition, as will be described in more detail below, lower rack assembly 122 (or any other rack assembly) may include a plurality of carrier roller assemblies 200 which slidably support lower rack assembly 122, thereby permitting the lower rack to roll out of wash chamber 106 and rest on door 116 when it is in the open (i.e., horizontal) position. Although a guide rails 120, rollers 128, and carrier roller assemblies 200 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Referring now generally to FIGS. 3 through 6, a lower rack and carrier roller assembly 200 will be described according to an example embodiment of the present subject matter. Carrier roller assembly 200 may be used as shown in FIG. 2 for supporting lower rack assembly 122. Carrier roller assembly 200 is generally configured for providing vertical support to a lower rack 202, which may be equivalent to lower rack assembly 122. In addition, as shown in the exemplary embodiment illustrated in FIG. 2, tub 104 of dishwasher 100 may define lower guide rails 204 and door 116 may define a lower rack rolling surface 206. In this manner, when door 116 is in the open position such that it extends substantially within a horizontal plane, carrier roller assembly 200 may permit lower rack 202 slide out of wash chamber 106 along the transverse direction T and rest on door 116 for loading and unloading dishes. Although carrier roller assembly 200 is illustrated as being used to support lower rack 202, it should be appreciated that carrier roller assembly 200 may be used with any suitable dishwasher rack.

Figure 3:
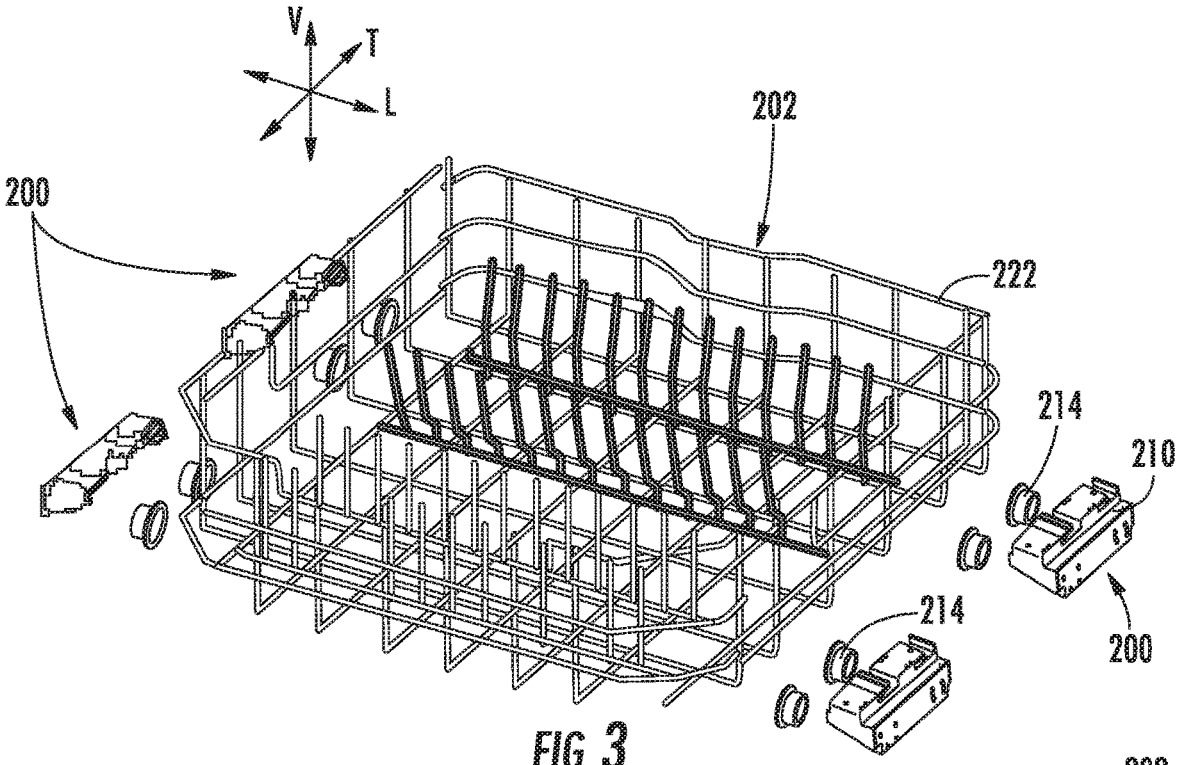
FIG. 3 provides an exploded view of a lower rack and carrier roller assemblies according to an example embodiment of the present subject matter.

As best shown in FIG. 3, lower rack 202 may be supported by four carrier roller assemblies 200. In this regard, two carrier roller assemblies 200 may be positioned on each lateral side of lower rack 202. Moreover, as described below, carrier roller assemblies 200 are designed to be interchangeably used on either the left side or the right side of lower rack 202. In this manner, a single set of molds may be used to form the left and right side carrier roller assemblies 200, thereby reducing manufacturing costs and complexity. Notably, when carrier roller assembly 200 is installed onto lower rack 202, carrier roller assembly 200 shares a coordinate system with dishwasher 100. Therefore, carrier roller assembly 200 will be described in herein as sharing the vertical direction V, the lateral direction L, and the transverse direction T with dishwasher 100.

Figure 4:
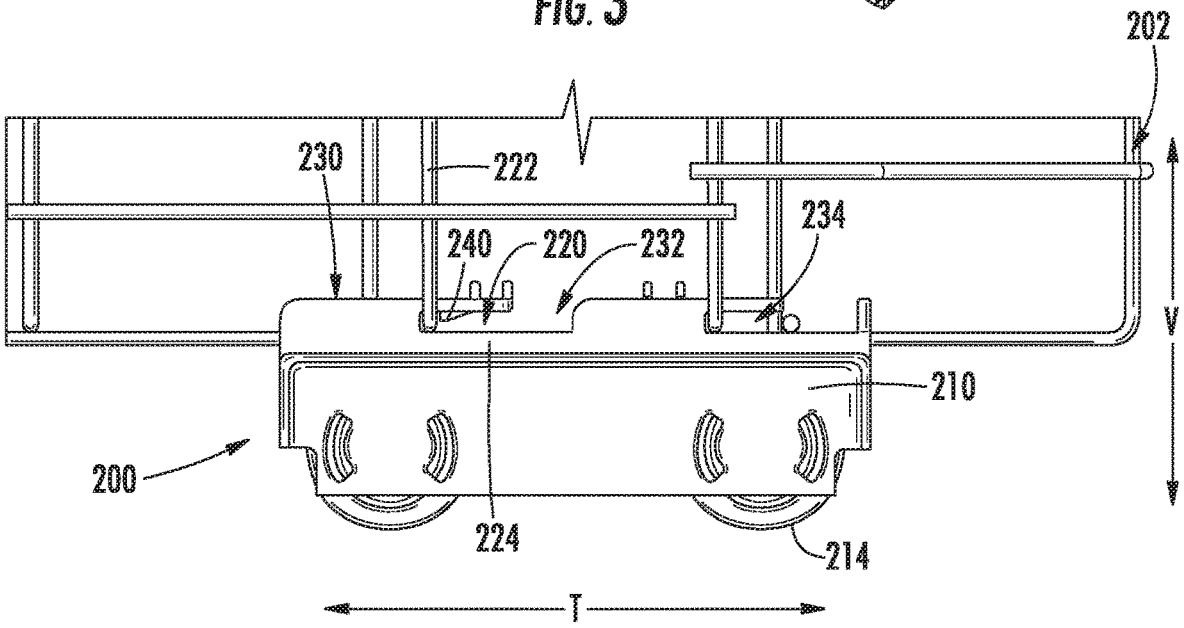
FIG. 4 provides a side view of the exemplary carrier roller assembly of FIG. 3 mounted on the lower rack according to an example embodiment of the present subject matter.
Figure 5:
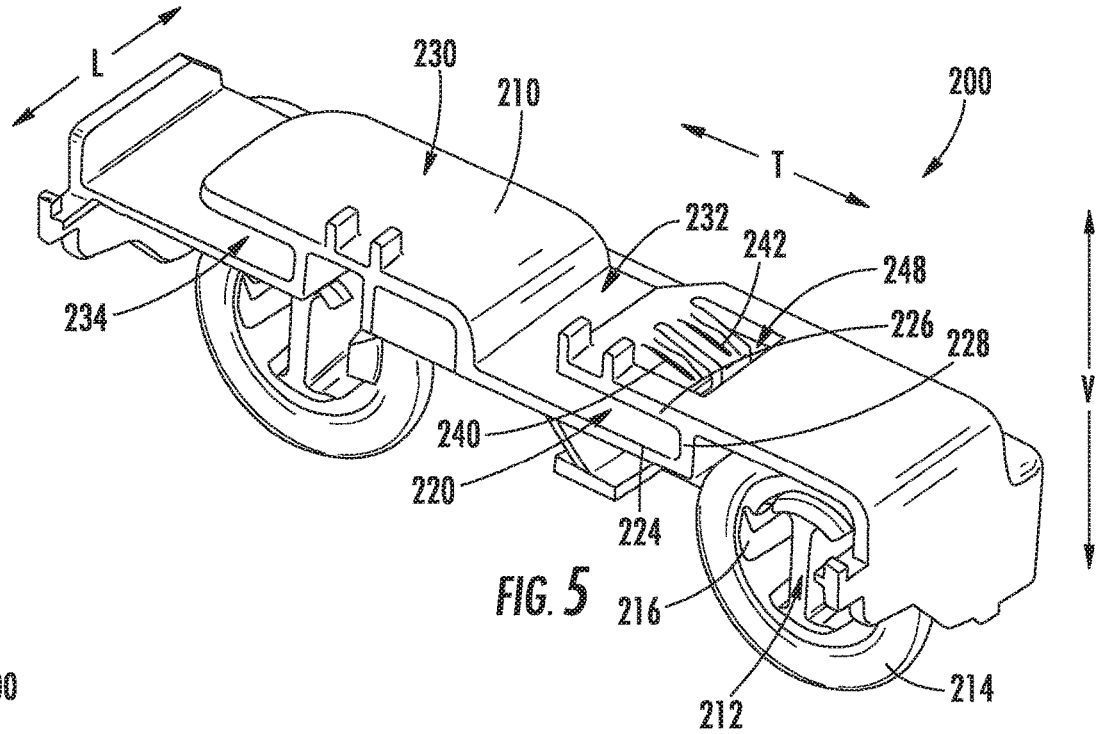
FIG. 5 provides a perspective view of the exemplary carrier roller assembly of FIG. 3 according to an example embodiment of the present subject matter.
Figure 6:
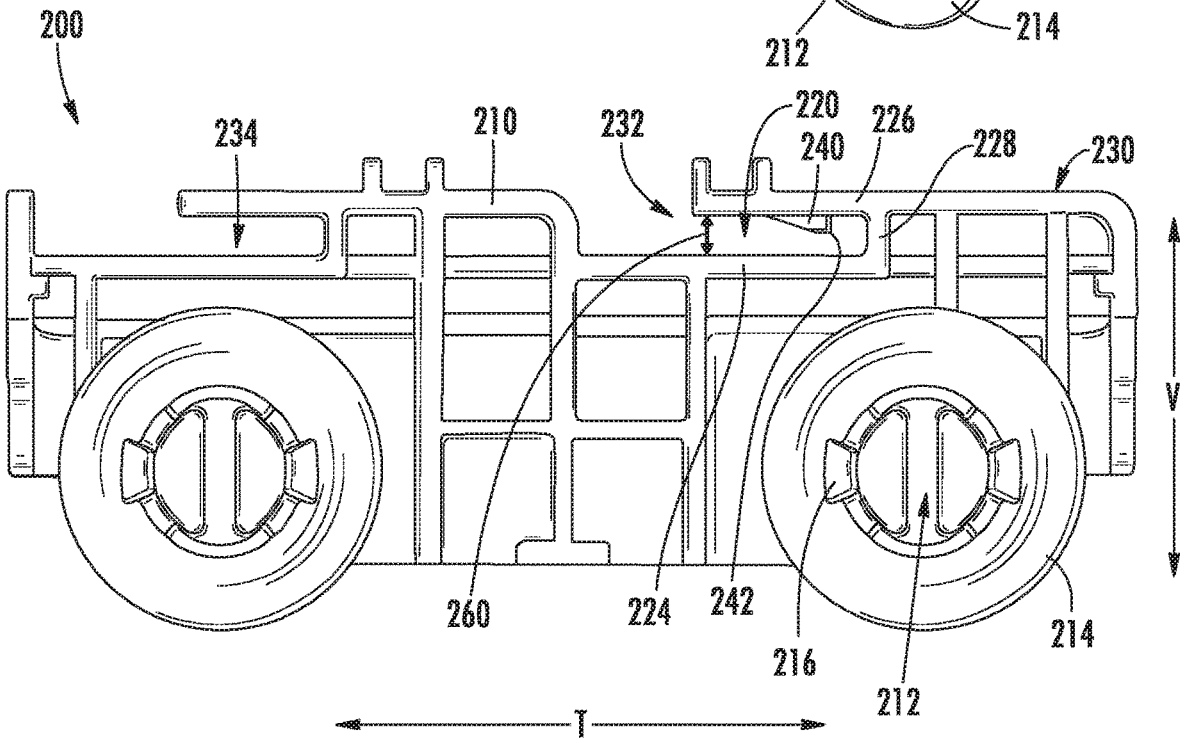
FIG. 6 provides a side view of the exemplary carrier roller assembly of FIG. 3 according to an example embodiment of the present subject matter.

Referring now to FIGS. 4 through 6, carrier roller assembly 200 includes a carrier body 210 that is mounted to lower rack 202 and defines a plurality of roller mounts 212. More specifically, according to the illustrated embodiment, carrier body 210 defines two roller mounts 212 that are spaced apart along the transverse direction T and extend along the lateral direction L. Carrier roller assembly 200 further includes a plurality of rollers 214 that are rotatably mounted onto the plurality of roller mounts 212. In this regard, rollers 214 may define a cylindrical channel that is received over roller mounts 212 may be secured in place using a pin or another latching feature, such as a resilient clip 216. Therefore, when rollers 214 are mounted onto roller mounts 212, and when carrier body 210 is fixed to lower rack 202, lower rack 202 may roll into and out of wash chamber 106, e.g., along lower guide rails 204 and lower rack rolling surface 206.

As illustrated, carrier body 210 also defines a receiving slot 220 that is generally configured for receiving a wire 222 of lower rack 202. More specifically, receiving slot 220 extends through carrier body 210 and is defined at least in part by a first wall 224, a second wall 226, and an end wall 228. In general, carrier roller assembly 200 is mounted on lower rack 202 by sliding carrier body 210 onto lower rack 202 such that wire 222 is received within receiving slot 220. According to the illustrated embodiment, receiving slot 220 is defined proximate a top surface 230 of carrier body 210. More specifically, receiving slot 220 extends from an entry 232 defined in top surface 230 and extends at least partially within the horizontal plane (i.e., as defined by the lateral direction L and transverse direction T) within carrier body 210. In order to further stabilize carrier roller assembly 200, carrier body 210 may further define a secondary slot 234 that is spaced apart from receiving slot 220 along the transverse direction T. Secondary slot 234 may have the same or a similar shape to receiving slot 220 and may be configured for receiving an adjacent wire 222 of lower rack 202.

The various components of carrier roller assembly 200 may be formed from any suitable material and in any suitable manner. For example, according to an exemplary embodiment, carrier body 210 is injection molded as a single piece using a suitably rigid plastic material. Similarly, rollers 214 are injection molded from plastic and snapped onto carrier body 210 to complete carrier roller assembly 200. Notably, such a construction reduces the number of parts necessary to assemble lower rack assembly 122 thereby reducing manufacturing time, costs, and complexity.

In order to secure carrier roller assembly 200 onto lower rack 202, carrier body 210 defines various features for locking lower rack 202, or more specifically wires 222, into carrier body 210. More specifically, according to an exemplary embodiment, carrier roller assembly 200 includes a first retention clip 240 and a second retention clip 242 that extend from carrier body 210 into receiving slot 220. In general, retention clips 240, 242 are resilient members configured for engaging and locking wire 222 in position at a bottom of receiving slot 220, i.e., where wire 222 is contacting end wall 228.

According to the illustrated embodiment, first retention clip 240 and second retention 242 are each flexible arms have a fixed end 244 positioned proximate entry 232 of receiving slot 220 and a distal end 246 that extends toward end wall 228 in a cantilevered manner. More specifically, an aperture 248 is defined through top surface 230 of carrier body 210 (i.e., through second wall 226). Retention clips 240, 242 extend from carrier body within aperture 248 and protrude down into receiving slot 220. In this manner, retention clips 240, 242 may deflect when wire 222 is pressed into receiving slot 220 until wire 222 clears retention clips 240, 242 which may then snap back into a relaxed position for preventing the subsequent removal of wire 222 from receiving slot 220.

Figure 7:
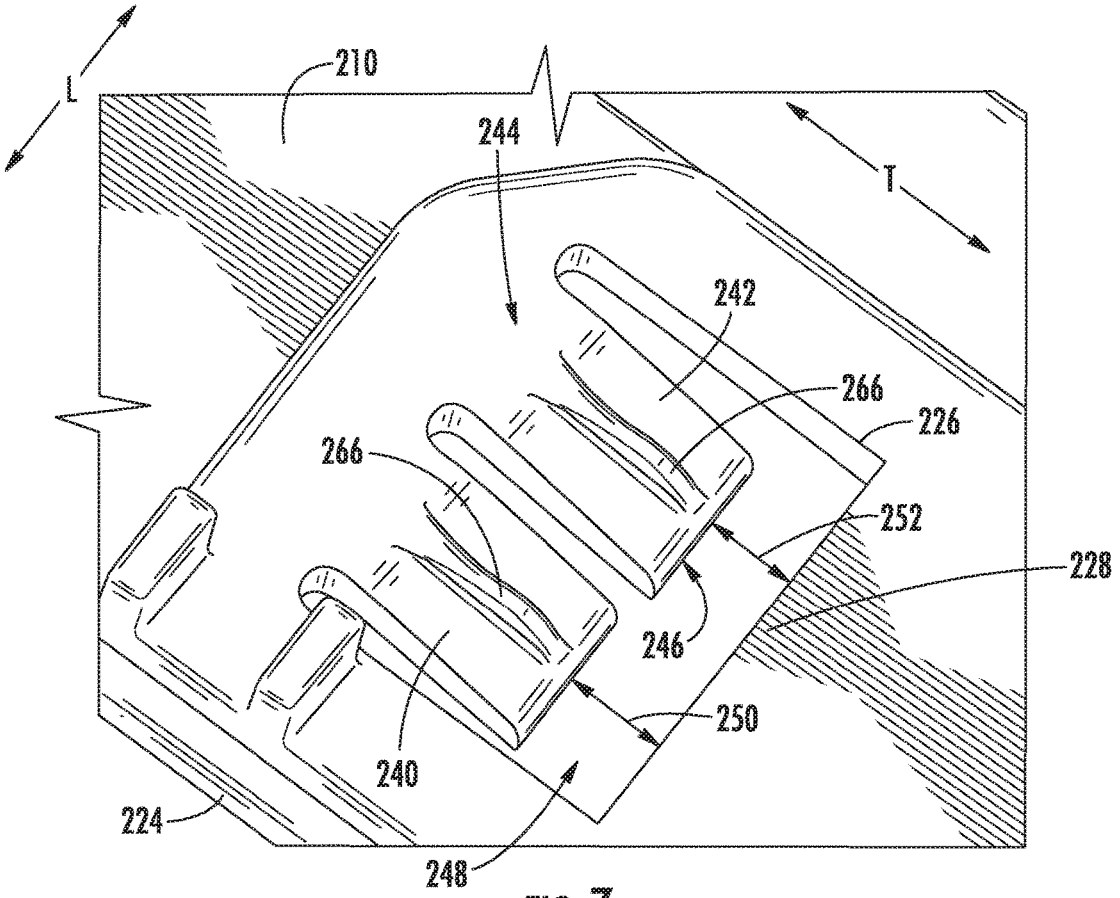
FIG. 7 provides a close-up view of retention features of the exemplary carrier roller assembly of FIG. 3 according to an exemplary embodiment of the subject matter.
Figure 8:
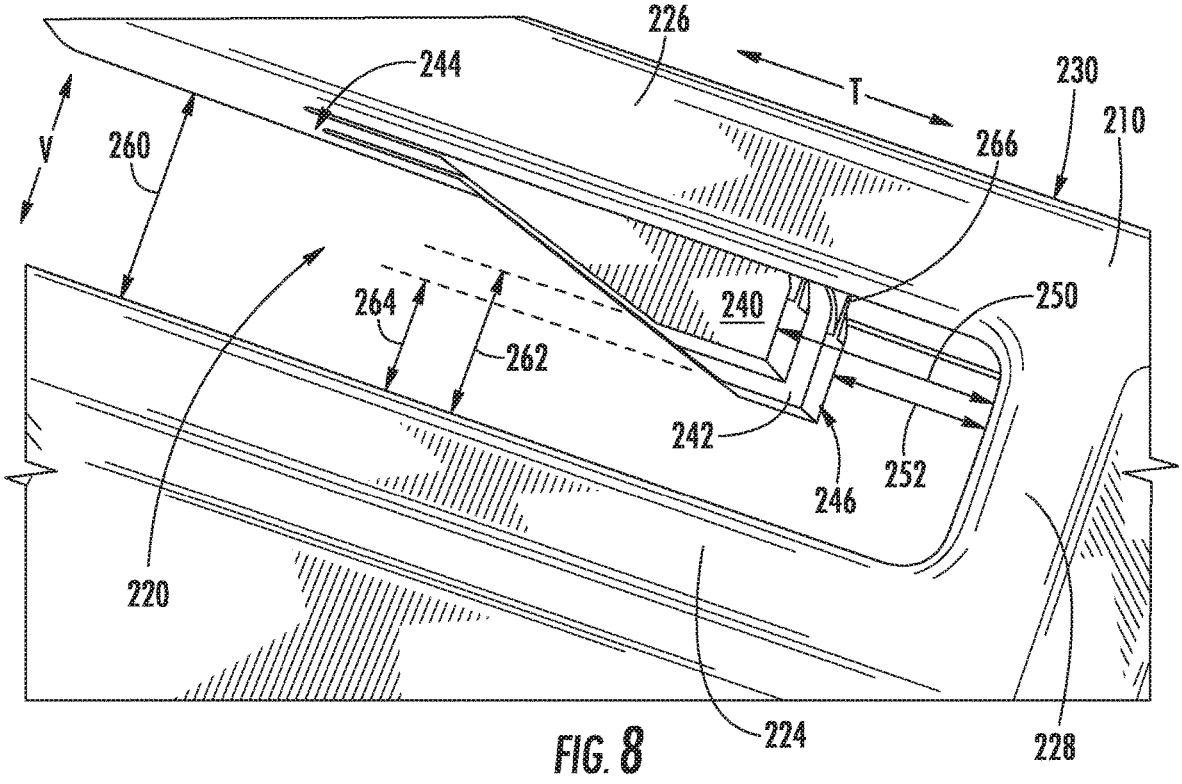
FIG. 8 provides another close-up view of retention features of the exemplary carrier roller assembly of FIG. 3 according to an exemplary embodiment of the subject matter.

Referring now to FIGS. 7 and 8, retention clips 240, 242 have a size and geometry for securing wires 222 having different diameters. In this regard, for example, distal end 246 of first retention clip 240 may be spaced apart from end wall 228 by a first distance 250 along the transverse direction T. Similarly, distal end 246 of second retention clip 242 may be spaced apart from end wall 228 by a second distance 252 along the transverse direction T. As illustrated, second distance 252 is smaller than the first distance 250. In this manner, if wire 222 has a diameter that is less than or substantially equal to first distance 250, first retention clip 240 will secure and lock wire 222 in place when pressed fully into receiving slot 220 (i.e., such that wire 222 contacts end wall 228). Similarly, if wire 222 has a diameter that is less than or substantially equal to second distance 252, second retention clip 242 will secure and lock wire 222 within receiving slot 220, while first retention clip 240 remains disengaged from wire 222.

As best shown in FIG. 8, receiving slot 220 further defines a slot height 260 between first wall 224 and second wall 226 along the vertical direction V. according to the illustrated embodiment slot height 260 is substantially equivalent to first distance 250 such that any wire 222 having a diameter less than or equal to first distance 250 may be received within receiving slot 220. In addition, retention clips 240, 242 both extend into receiving slot 220 along the vertical direction V to define a gap height between first wall 224 and each respective retention clip 240, 242. More specifically, according to the illustrated exemplary embodiment, first retention clip 240 protrudes into receiving slot 220 to define a first gap height 262, which according to an exemplary embodiment is equal to about half of slot height 260. Similarly second retention clip 242 protrudes into receiving slot 220 to define a second gap height 264 which is less than the first gap height 262.

It should be appreciated that retention clips 240, 242 and receiving slot 220 are described above according to an exemplary embodiment to explain aspects of the present subject matter. It should be appreciated that the size and geometry of these features may be changed according to alternative embodiments. For example, the size, resiliency, and geometry of retention clips 240, 242 may be altered to accommodate wires 222 having different sizes. In addition, the lengths of retention clips 240, 242, the gap height and the gap distances defined within receiving slot 220 may be altered depending on the resiliency of retention clips 240, 242 and the size of wire 222. According to still another embodiment, each retention clip may define a stiffening rib 266 that extend along the transverse direction T on each clip to provide additional rigidity. Other configurations of retention clips 240, 242 are possible and within the scope of the present subject matter.

By defining carrier body 210 and retention clips 240, 242 as described above, carrier roller assembly 200 may be used in dishwasher appliances having lower racks formed from different types of wire. In this regard, for example, a typical wire 222 that is formed from polyvinyl chloride (PVC) may have a maximum diameter of approximately 0.18 inches. By contrast, a typical wire 222 that is formed from nylon may have a maximum diameter of approximately 0.17 inches. According to alternative embodiments, typical wire 222 may have any other suitable size, such as between 0.15 and 0.19 inches. Notably, retention clips 240, 242 may define first distance 250 and second distance 252 to be approximately 0.18 and 0.17 inches, respectively, to enable carrier roller assembly 200 to be used to support lower racks formed from either PVC or nylon wires. As described above, carrier body 210 defines two retention clips 240, 242 which may be used for mounting carrier roller assembly 200 to lower racks formed from wires having two different diameters. However, it should be appreciated that according to alternative embodiments, carrier body 210 may define any suitable number retention clips for securing any suitable size wire 222, being constructed of any material and having any suitable type and thickness of coating.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a wash tub that defines a wash chamber for receipt of articles for washing;

a rack slidably positioned within the wash chamber and configured for movement along the transverse direction;

a door rotatably mounted to the wash tub for providing selective access to the wash chamber; and a carrier roller assembly for supporting the rack, the carrier roller assembly comprising:

a carrier body mounted to the rack, the carrier body defining a receiving slot for receiving a wire of the rack, the receiving slot being defined in part by a first wall and an end wall;

a first retention clip extending from the carrier body into the receiving slot, a distal end of the first retention clip being spaced apart from the first wall by a first gap height; and a second retention clip extending from the carrier body into the receiving slot, a distal end of the second retention clip being spaced apart from the first wall by a second gap height, the second gap height being smaller than the first gap height, wherein the wire of the rack is seated against the end wall when the rack is installed in the carrier body.

2. The dishwasher appliance of claim 1, wherein the first gap height is equal to about half of a slot height.

3. The dishwasher appliance of claim 1, wherein the receiving slot is defined in part by the end wall, and wherein the distal end of the first retention clip is spaced apart from the end wall by a first distance and the distal end of the second retention clip is spaced apart from the end wall by a second distance, the second distance being smaller than the first distance.

4. The dishwasher appliance of claim 3, wherein the receiving slot defines a slot height that is substantially the same as the first distance.

5. The dishwasher appliance of claim 3, wherein the first retention clip secures the wire if it has a diameter less than or equal to the first distance and the first gap height and the second retention clip secures the wire if it has a diameter less than or equal to the second distance and the second gap height.

6. The dishwasher appliance of claim 3, wherein the first distance and the first gap height are approximately 0.18 inches and the second distance and the second gap height is approximately 0.17 inches.

7. The dishwasher appliance of claim 1, wherein the first retention clip is configured for retaining a polyvinyl chloride wire and the second retention clip is configured for retaining a nylon wire.

8. The dishwasher appliance of claim 1, wherein the first retention clip and the second retention clips are flexible arms each having a fixed end positioned proximate an entry of the receiving slot and the distal end that extends toward the end wall of the receiving slot in a cantilevered manner.

9. The dishwasher appliance of claim 1, wherein the carrier body defines a plurality of roller mounts, the roller mounts extending substantially along the lateral direction, the carrier roller assembly further comprising:

a plurality of rollers rotatably mounted on the plurality of roller mounts, the plurality of rollers configured for rolling along a rack rolling surface when the rack is moved out of the wash chamber.

10. The dishwasher appliance of claim 1, wherein the carrier roller assembly is used interchangeably on a left side of the rack and a right side of the rack.

11. The dishwasher appliance of claim 1, wherein the carrier body further defines a secondary slot spaced apart from the receiving slot along the transverse direction, the secondary slot configured for receiving an adjacent wire of the rack.

12. The dishwasher appliance of claim 1, wherein the receiving slot is defined on a top surface of the carrier body.

13. The dishwasher appliance of claim 1, wherein the receiving slot extends at least partially within a horizontal plane within the carrier body.

14. The dishwasher appliance of claim 1, wherein the carrier body is injection-molded as a single piece using a plastic material.

15. A carrier roller assembly for supporting a rack within a wash chamber of a dishwasher appliance, the carrier roller assembly comprising:

a carrier body mounted to the rack, the carrier body defining a receiving slot for receiving a wire of the rack, the receiving slot being defined in part by a first wall and an end wall;

a first retention clip extending from the carrier body into the receiving slot, a distal end of the first retention clip being spaced apart from the first wall by a first gap height; and a second retention clip extending from the carrier body into the receiving slot, a distal end of the second retention clip being spaced apart from the first wall by a second gap height, the second gap height being smaller than the first gap height, wherein the wire of the rack is seated against the end wall when the rack is installed in the carrier body.

16. The carrier roller assembly of claim 15, wherein the first gap height is equal to about half of a slot height.

17. The carrier roller assembly of claim 15, wherein the receiving slot is defined in part by the end wall, and wherein the distal end of the first retention clip is spaced apart from the end wall by a first distance and the distal end of the second retention clip is spaced apart from the end wall by a second distance, the second distance being smaller than the first distance.

18. The carrier roller assembly of claim 17, wherein the receiving slot defines a slot height that is substantially the same as the first distance.

19. The carrier roller assembly of claim 15, wherein the first retention clip and the second retention clips are flexible arms each having a fixed end positioned proximate an entry of the receiving slot and the distal end that extends toward the end wall of the receiving slot in a cantilevered manner.

20. The carrier roller assembly of claim 15, wherein the carrier roller assembly is used interchangeably on a left side of the rack and a right side of the rack.

* * * * *